US008281477B2

(12) United States Patent
Münster et al.

(10) Patent No.: US 8,281,477 B2
(45) Date of Patent: Oct. 9, 2012

(54) METHOD FOR SETTING NEEDLES IN NEEDLE BOARDS FOR FELTING MACHINES

(75) Inventors: Bernhard Münster, Meβstetten (DE); Gustav Wizemann, Meβstetten-Hossinger (DE); Johannes Bruske, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 1259 days.

(21) Appl. No.: 12/068,156

(22) Filed: Feb. 4, 2008

(65) Prior Publication Data

US 2008/0184546 A1 Aug. 7, 2008

(30) Foreign Application Priority Data

Feb. 2, 2007 (EP) ..... 07002360

(51) Int. Cl.
*B23P 11/00* (2006.01)
*D04H 18/00* (2006.01)

(52) U.S. Cl. ..... 29/525; 29/426.1; 29/464; 29/559; 29/700; 28/115

(58) Field of Classification Search ..... 29/426.1, 29/426.5, 464, 525, 559, 700, 811.2, 244; 28/115; 279/44, 66, 110, 118, 119
See application file for complete search history.

(56) References Cited

U.S. PATENT DOCUMENTS

| | | | |
|---|---|---|---|
| 3,388,443 | A | 6/1968 | O'Byrne |
| 6,233,797 | B1 | 5/2001 | Neely et al. |
| 2004/0055916 | A1 | 3/2004 | Faller et al. |

FOREIGN PATENT DOCUMENTS

| | | | |
|---|---|---|---|
| DE | 1 923 665 | | 9/1965 |
| DE | 31 05 358 | A1 | 9/1982 |
| DE | G 83 29 050.8 | | 1/1984 |
| DE | 195 21 796 | C1 | 7/1996 |
| EP | 1 069 224 | A1 | 1/2001 |
| EP | 1 391 546 | A1 | 2/2004 |
| EP | 1 400 619 | A1 | 3/2004 |

*Primary Examiner* — Jermie Cozart
(74) *Attorney, Agent, or Firm* — Fitch, Even, Tabin & Flannery, LLP

(57) ABSTRACT

A semi-automatic loader for needle boards (2) includes a filling device (51)that presents felting needles (17) arranged at a ratio that is consistent with the ratio of holes of a needle board. A machine operator can then grasp the felting 5 needles (17) by use of a multiple collet chuck (45) and set them in groups in the rows of holes of the needle board (2). This provides a loading method featuring extremely high productivity.

7 Claims, 5 Drawing Sheets

METHOD FOR SETTING NEEDLES IN NEEDLE BOARDS FOR FELTING MACHINES

CROSS-REFERENCE TO RELATED APPLICATION

This application claims the priority of European Patent Application 07 002 360.1, filed Feb. 2, 2007, the subject matter of which, in its entirety, is incorporated herein by reference.

BACKGROUND OF THE INVENTION

The invention relates to a method and a device for setting needles in needle boards for felting machines and for removing needles from said needle boards.

Felting machines are used to render dense fibrous structures consisting of fibers in an unordered configuration such as, for example, fleeces (with and without carrier materials), and are also occasionally used for the subsequent processing of woven or knit materials. To achieve this, felting machines comprise an essentially flat support that is provided with a large number of felting needles. This support is also referred to as a needle board. The felting needles are seated in appropriate openings, said felting needles having a holding section that is pushed into said board. The term "felting needle" used herein also comprises needles that are used for subsequent processing, e.g., for roughening or even for perforating knit or woven materials.

The planting of the needles in the needle board is a tedious process which, in many cases, must be completely or partially performed by hand. If the needles are worn or if the needles of a needle board need to be replaced for any other reason, the old needles must be removed from the needle board and the new needles must be set into the needle board. This is a time-consuming operation. Therefore, in the past, attempts have been made to at least partially automate the process. Regarding this, Utility Model DE 83 29 050 U1 discloses an automatic planting device comprising a felting needle magazine. Said magazine is positioned above a needle board. The opening in the needle board can be detected by suitable optoelectronic sensors. Via an appropriate mechanical drive, the needles can then be transferred from the magazine into the holes.

Furthermore, utility model DE 19 23 665 has disclosed a device for the insertion of needles in a needle board and their ejection therefrom. The machine comprises a movable frame that can be positioned above a needle board. A pressure-exerting stamp provided on the device can be moved in vertical direction by the force of a motor in order to apply pressure on the needle tips and thus release the needles from their seat. Similarly, the same machine is used to firmly push felting needles that have been loosely set into a needle board into said needle board.

Some literature references deal with partial aspects of problems occurring when removing needles from the needle board or when setting said needles therein. However, there is still no system or device with which needles can be efficiently set in needle boards.

Considering this, it is the object of the invention to provide a method and a device for the rapid setting of needles in needle boards.

SUMMARY OF THE INVENTION

The method and device of the present invention achieve the above object.

Referring to the method in accordance with the invention, a multiple collect chuck is used to grasp several felting needles at the same time and insert them in their respective openings of the needle board. In the multiple collet chuck, the felting needles are held at a distance from each other in such a manner that said distance corresponds to the distance between the holes of the needle board. In this manner, an automatic manipulator or an appropriately trained machine operator can plant, respectively, an entire group of felting needles in the needle board by means of the multiple collet chuck. In so doing, rows of holes can be planted with needles by a few manual actions or by a few process steps. An appropriate depressing device can push the needles in a row of holes into the needle board in a single stroke.

Preferably, the collet chuck is configured in such a manner that it can hold the individual felting needles at almost any desired distances, i.e., at any desired ratio. The felting needles, e.g., are clamped between two chuck jaws. The multiple collet chuck, however, is associated with a filling device that is designed to hold ready and available the group of felting needles that is to be received by the multiple collet chuck at the dividing ratio that also exists on the needle board. Preferably, one of the chuck jaws has cutouts that correspond to the pre-specified dividing ratio of the filling device. The depth of the cutouts is less than the thickness of the needle, so that the felting needles located in the cutouts can be clamped in place by the smooth inside of the second chuck jaw. The filling device removes the needles from a needle container, for example, holding a large number of appropriate felting needles that are loosely arranged, however, are aligned, i.e., for example, parallel to each other, or oriented in the same direction. The separation of the felting needles and their presentation for being grasped by the multiple collet chuck is achieved, for example, via a separating device comprising several threaded spindles on which the felting needles are located in an orientation transverse to the axis of rotation of said threaded spindles.

In order to perform the method, a work station that is appropriately equipped for setting needles in needle boards preferably comprises the following components: a holding device for the needle board that is to be planted with needles, the mentioned multiple collet chuck, a filling device for filling said multiple collet chuck and a depressing device that is disposed to push into the needle board the felting needles that have been set into said needle board. Preferably, a transport device is additionally provided, said transport device acting to transfer the needle board out of a planting position into the depressing device, thus considerably facilitating the work of setting needles in a needle board.

The filling device pre-specifies the needle ratio. The term "needle ratio" is understood to mean the distance of the felting needles within a row that extends parallel to the longitudinal side of the needle board. In so doing, the filling device may comprise two threaded spindles having a thread pitch corresponding to the desired needle ratio. The needle ratio and the distance of the rows of needles of a needle board can be detected by a camera or another type of sensor device. The threaded spindles can be exchanged manually, for example. The machine control can prompt the machine operator to remove the threaded spindles matching the detected ratio from a supply and to set said spindles into the filling device.

Referring to a particularly advantageous embodiment of the inventive device, an extracting device for removing the needles of a needle board is provided in addition to the depressing device. The extracting device may be arranged in the immediate vicinity of the depressing device. Preferably, said extracting device is provided with a pressure-applying strip which can be used to exert pressure on the operating parts of the felting needles in order to loosen the felting needles. This extracting device preferably includes one or more hook strips which extend behind the loosened feet of the felting needles and can apply a pulling force on said needles in order to extract the felting needles from the needle board.

Additional details of advantageous embodiments of the invention are obvious from the claims as well as from the drawings and the description hereinafter. The description is restricted to essential aspects of the invention and to miscellaneous situations. The description should be used in a supplementary manner.

DETAILED DESCRIPTION OF THE INVENTION

Figure 1:
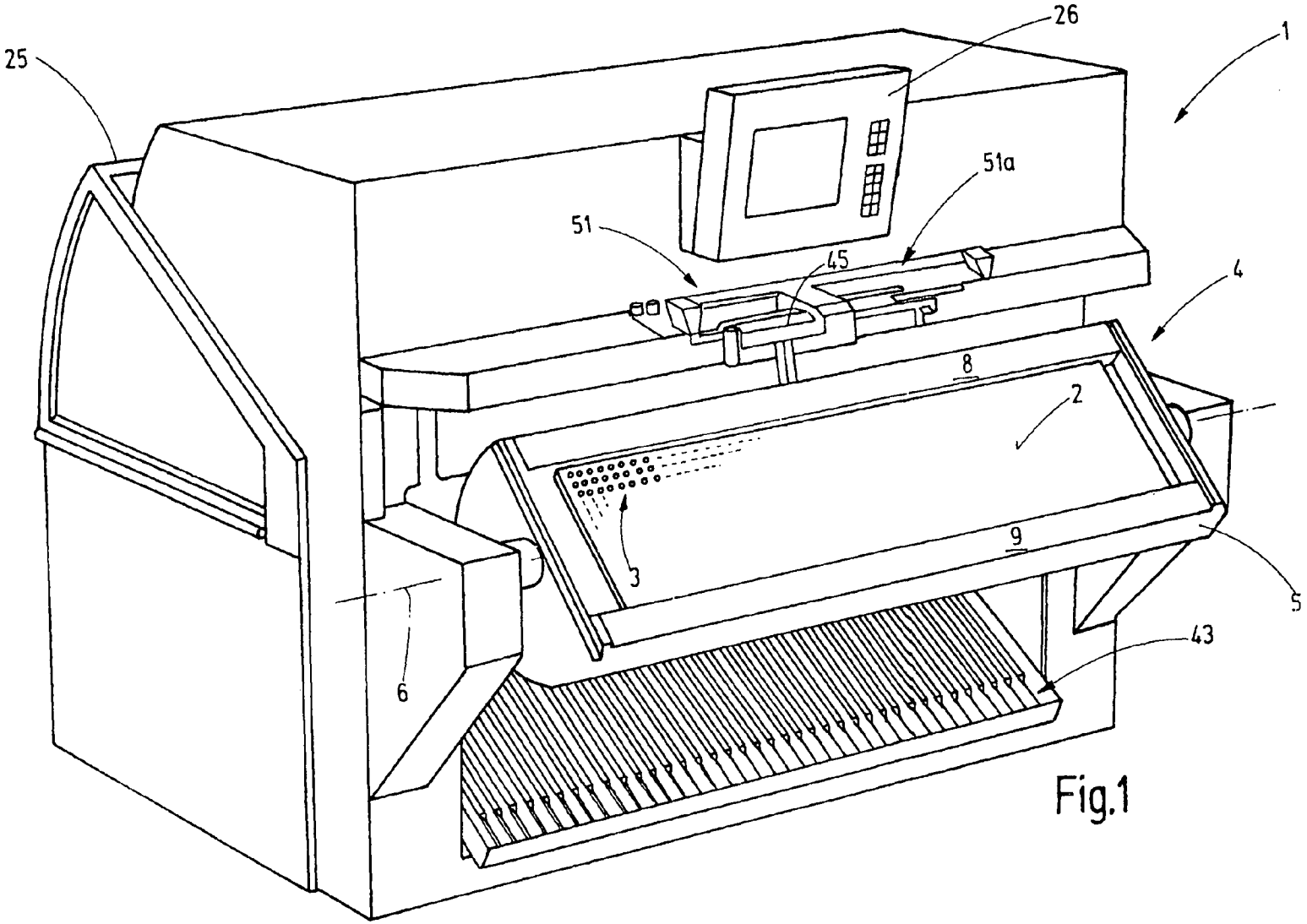
FIG. 1 illustrates a device for setting needles in needle boards of felting machines and for removing said needles from said needle boards.

FIG. 1 shows a device 1 for setting needles in needle boards 2 for felting machines. The device 1 is configured as a semi-automatic loader. Such needle boards 2 are used, for example, to produce felt in felting machines. The needle board 2 has a large number of holes 3, which are arranged in rows that extend longitudinally, transversely or diagonally. Such a needle board may have dimensions of 1.70 m×0.4 m, for example. The openings 3 or their central axes are mostly oriented essentially parallel to each other and are aligned at right angles to the flat needle board 2. Within a row of openings 3, the distance between the holes, i.e., the distances (of the centers) of the holes from each other, are essentially constant.

The semi-automatic loader in accordance with FIG. 1 comprises a holding device 4 for the needle board 2. The holding device 4 is designed as a rotary table. Said table comprises a board frame 5 which is supported so as to be preferably pivotable or rotatable about a horizontal axis of rotation 6. To do so, the board frame 5 can be positioned by being pivoted by means of drives that are not specifically illustrated. These drives are supported on the machine frame of the device 1. The board frame 5 comprises a board guide 7, as is obvious, for example, from the schematic view of FIG. 2. The board guide 7 includes guide rails 8, 9 that are arranged at a distance parallel to each other and are disposed to receive the needle board 2 between each other. The guide rails 8, 9 form a linear guide for the board 2. Said rails permit the needle board 2 to be laterally pushed toward or pulled away from the holding device 4 in a direction parallel to the axis of rotation 6. In order to facilitate this operation, several rollers 10, 11, 12, 13 may be arranged on the board frame 5, said rollers being rotatably supported and representing a roller guide for the needle board 2. Preferably, the rollers 10, 11, 12, 13 are movably arranged on the needle board 2 so that they can be moved toward said board and away therefrom. Electric or hydraulic actuators may be used to achieve this movement. If the needle board 2 is to be moved on the holding device 4, the rollers 11 through 13 are moved toward the needle board 2 until they lift the needle board 2 off the appropriate abutment surfaces. Now, the needle board 2 can be easily moved. For planting, as opposed to this, the rollers 11 through 13 are lowered, for example, by hydraulic means. In so doing, the needle board 2 can be supported by appropriate abutment surfaces of the board frame 5. A locking device, for example, configured as hydraulic the clamping claws 14, 15, provided at the guide rails 8, 9 or at another suitable location can now clamp the needle board 2 in place on the board frame 5.

Figure 2:
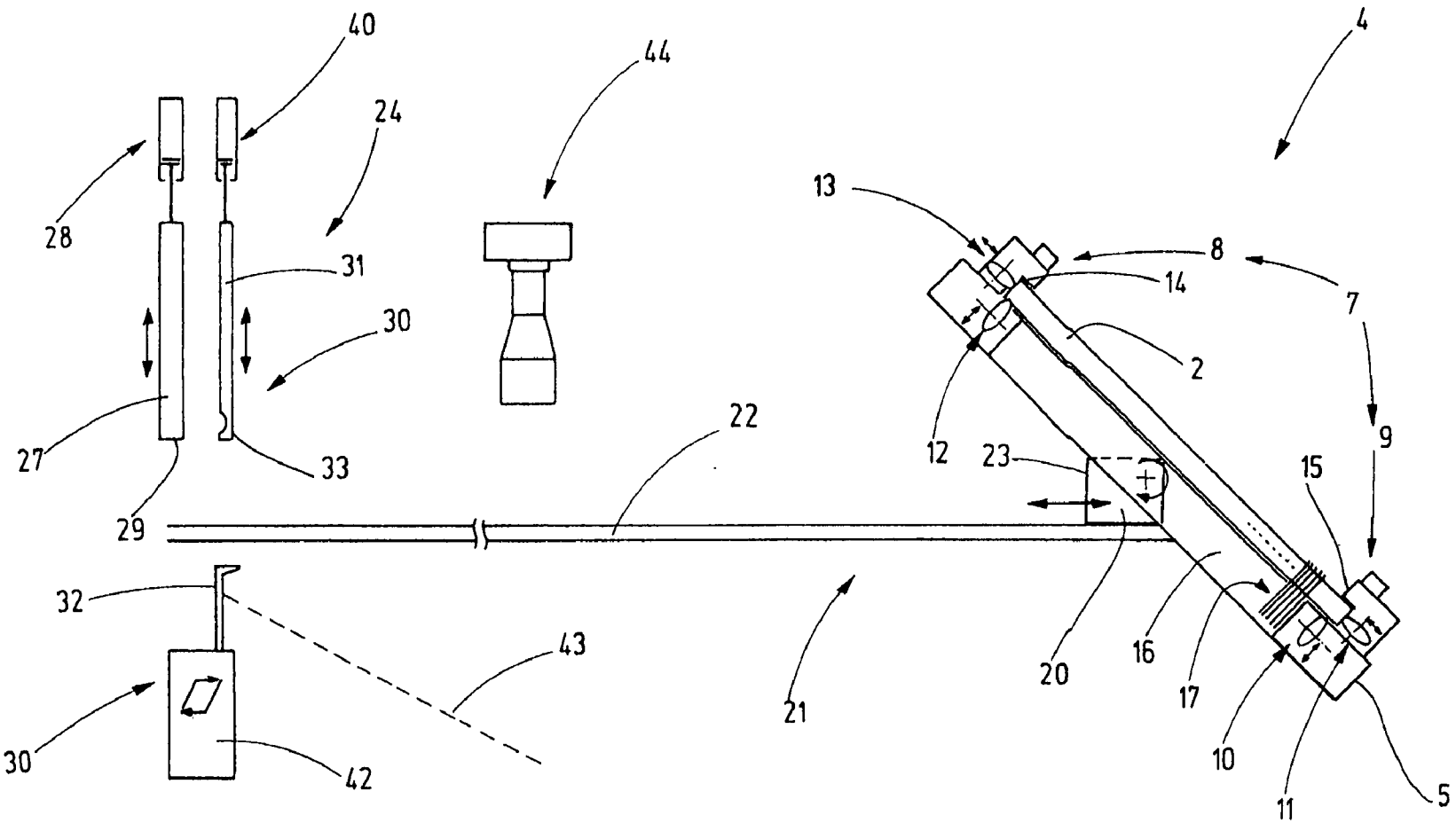
FIG. 2 is a schematic diagram of components of the device in accordance with FIG. 1.
Figure 3:
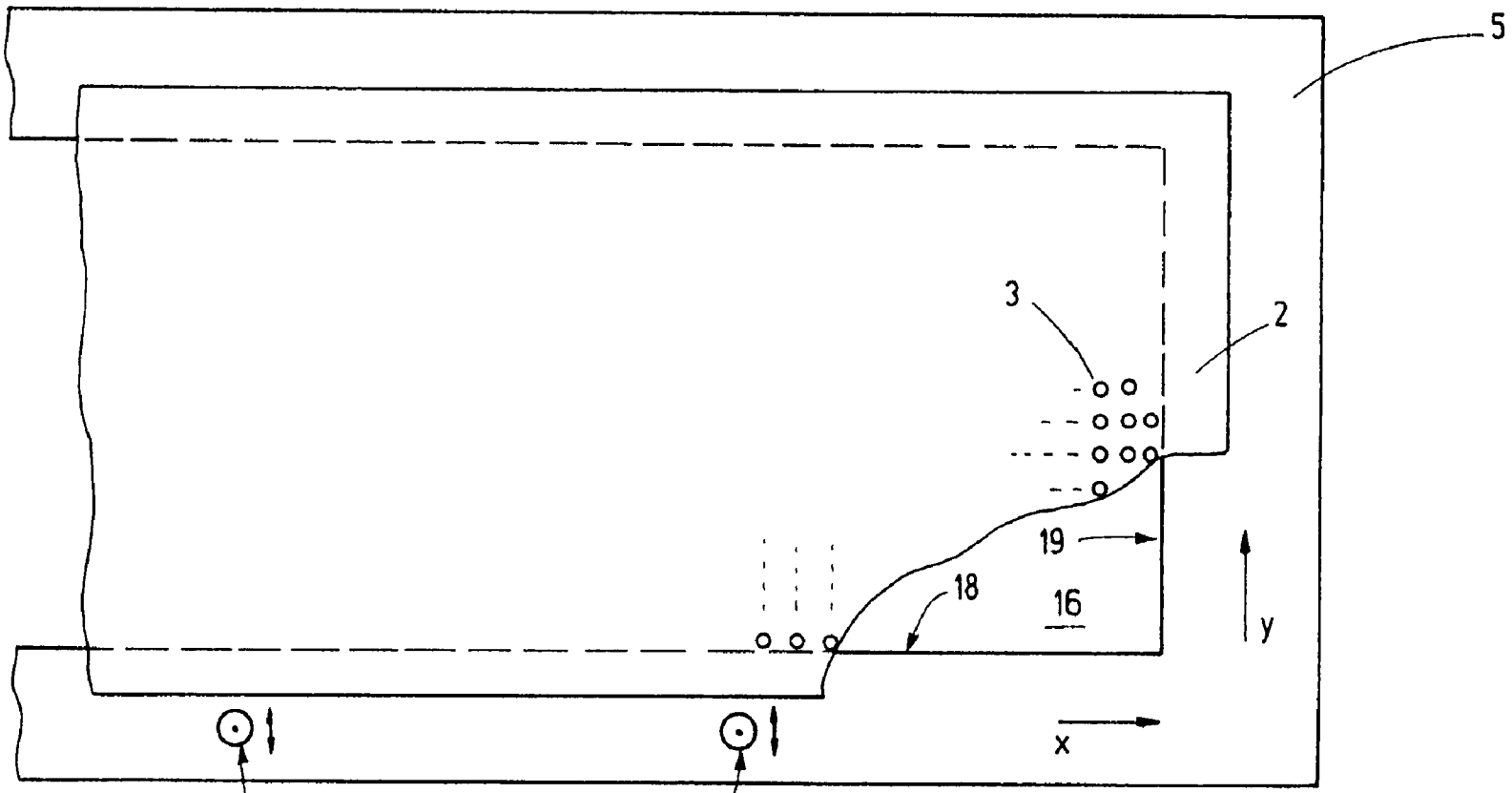
FIG. 3 is a schematic plan view of a holding device for a needle board.

As shown by FIGS. 2 and 3, the board frame 5 preferably has one central opening 16 into which extend the felting needles 17 held on the needle board 2. As is obvious from FIG. 3, the edge of this opening 16 may act as an abutment surface and thus as an abutment means for positioning the needle board 2. This applies considering the X-direction as well as considering the Y-direction shown symbolically in FIG. 3. The abutments 18, 19 that are thusly formed by parts of the wall of opening 16 consequently do not act on the edges of the needle board 2 but on the felting needles 17 that are located outside. The abutments 18, 19 may also be formed by resilient strips or the like. In particular, this may be of advantage considering the X-direction in order to not damage the needles that are located on the outside when the needle board 2 is moved in and when said needles on the outside impact the abutment 19.

As indicated by FIG. 2, the holding device 4 is supported by its rotary positioning device 20. Said positioning device can pivot the needle board into a vertical position, a diagonal position (shown by FIGS. 1 and 2) or even into a horizontal position. Optionally, any position in between may be adjusted. The positioning device 20 may be part of a transport device 21 as indicated by a linear guide device in FIG. 2. This linear guide device comprises guide rails 22 and a carriage 23 which is represented by the positioning device 20. It is used to transfer the holding device 4 with the needle board 2 out of the right planting position on the right in FIG. 2 into a depressing or needle-removing position 24. While the needle board 2 in planting position, as indicated by FIG. 1, is accessible in the form of a desk to a machine operator, the depressing and needle-removing position 24 is preferably located in a zone of the semi-automatic loader that is covered by a hood 25 (FIG. 1). This loader represents a preferably illuminated work space that can be viewed through a sight glass. However, the hood 25 prevents machine operators from having direct access.

The transport device 21 comprises drive means that are not specifically illustrated; these drive means can be used—controlled by a machine control device 26 (FIG. 1)—so as to move the holding device 4 supported by the positioning device 20. The movement of the holding device 4 with the needle board 2 out of the loading position into the depressing and needle-removing position 24 is preferably initiated by the machine operator's prompt.

In the depressing and needle-removing position 24, at least one depressing device is provided, said depressing device comprising a push-in strip 27 and a suitable drive device, for example, several hydraulic cylinders 28 or even other actuators, and being movable toward the needle board 2 and away therefrom. In so doing, the push-in strip 27 is preferably held so as to be linearly movable in vertical direction in order to interact with a horizontally held needle board 2 in said board's depressing position 24. On its lower face—which faces the needle board 2 held under it in the operative position—the push-in strip 27 has a pressure surface 29. This pressure surface 29 has a section configured as a prism as well as a planar section. During the depressing operation, the felting needles 17 that are to be pushed in are initially pushed into the needle board 2 by the prism-shaped section of the pressure surface 29 of the depressing strip 27. The prism-shaped guide ensures that the felting needles 17 are held in a laterally stable manner during the depressing operation. The needles cannot be displaced. The depressing operation is completed in that the push-in strip 27 is laterally displaced in order to completely push the felting needles 17 into the needle board 2 by means of the flat area of the pressure surface 29. The pressure surface 29 extends over the entire working width of the device 1 and thus has at least the length of one row of holes of the needle board 2. Referring to a preferred embodiment, the pressure surface 29 is not absolutely straight with respect to the X-direction that is parallel to the axis of rotation 6. Rather, it is preferred, that the pressure surface 29 be very minimally curved or slightly chamfered so that the pressure surface 29 will extend into the region of the center of the push-in strip 27 approximately one to two millimeters below its ends. This measure helps compensate for any bending of the board which results, when the felting needles are pushed into the openings 3, due to the large forces that come into action and due to the existing flexibility of the needle board 2.

Figure 4:
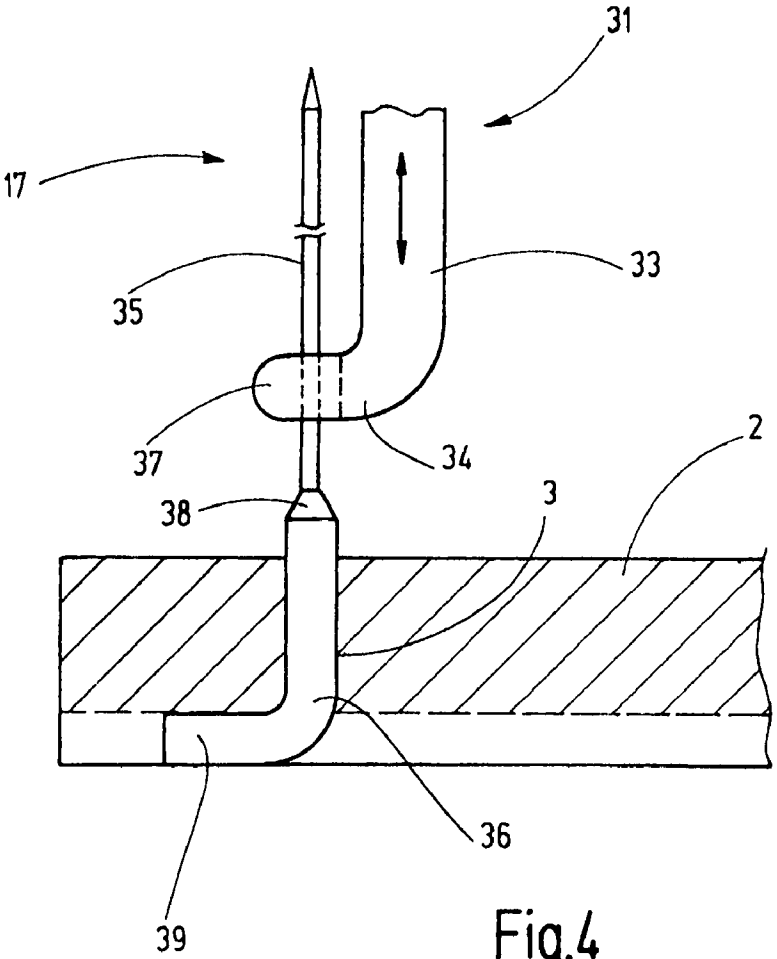

An extracting device 30 may be arranged in the immediate vicinity of the push-in strip 27. Said extracting device comprises one or more push-out strips 31 as well as a corresponding number of extracting strips 32. Again, each push-out strip 31 preferably extends across the entire length of a needle board 2. It has a foot section 33 as is obvious from FIG. 4. A lower, angled section 34 of the foot section 33 is provided with slits 37, the ratio of said slits being consistent with the ratio of holes of the needle board 2. Referring to the preferred exemplary embodiment, four such push-out strips 31 are provided in close vicinity of each other, whereby the four push-out strips have slits in a ratio that corresponds to the four most common ratios of needle boards 2. The section 34 of the push-out strip 31 matching the corresponding needle board 2, as is shown by FIG. 4, can be slid over the working parts 35 of the felting needles 17, said felting needles' holding parts 36 being seated in the openings 3. The slits 37 comprise the working parts 35 with play. However, they are tighter than the holding parts 36. Therefore, when it is being lowered, the push-out strip 31 comes to be seated on the conical section 38 of each felting needle 17 and slightly moves the holding part 36 that is held in the seat clamping the holding part 36. Consequently, the foot 39 of each felting needle 17 is slightly moved away from the needle board 2.

It is also possible for the push-out strip 31 to have a lower section 34 that has a straight form. In this case, the push-out strip 34 has a bore with a diameter that is slightly greater than the diameter of the working part 35 of the felting needle 17. The free end of this bore has a conical section that approximately corresponds to the conical section 38 of the felting needle 17, said section connecting the working part 35 with the holding part 36 of the felting needle 17. Then, by means of this conical section, the push-out strip 31 pushes the felting needles 17 partially out of the needle board 2 or out of its openings 3.

Each of the push-out strips 31 can be vertically moved back and forth by its own drive such as, for example, hydraulic cylinders 40 (FIG. 2). Preferably, the working stroke is greater than the length of the working part 35.

Figure 5:
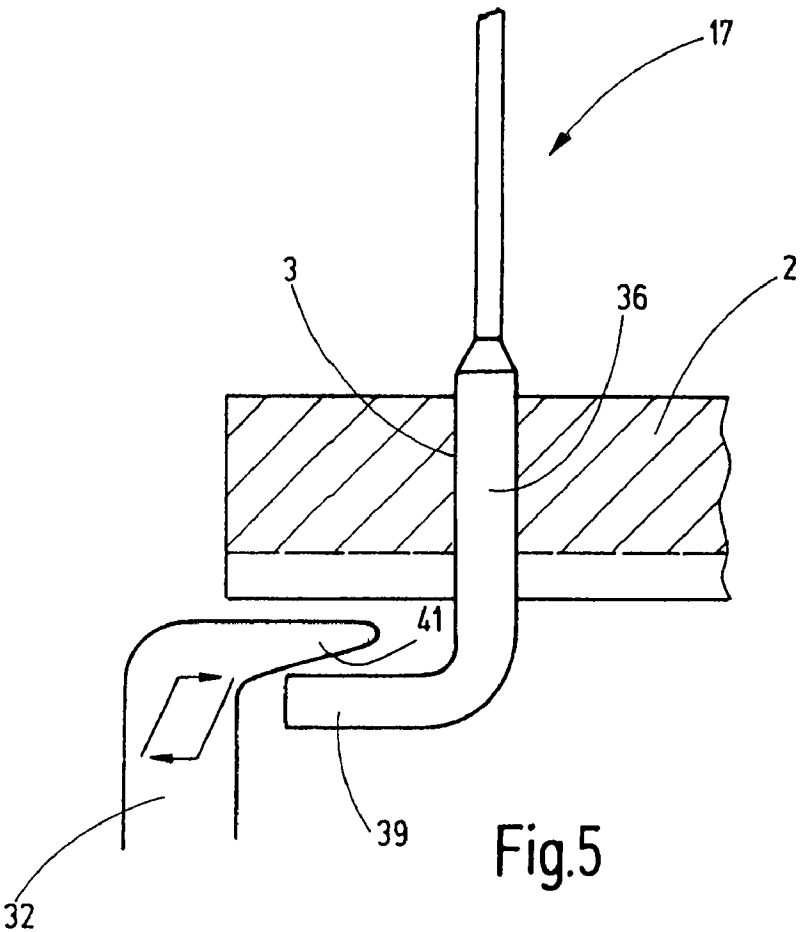
FIGS. 4 and 5 are schematic views showing the extraction of a felting needle from a needle board.

The extracting device 30 also comprises the extracting strip 32 shown in FIG. 5. Each push-out strip 31 (if there are several) can also be associated with an extracting strip 32. The extracting strip 32 extends along the entire length of the row of needles or the row of holes of the needle board 2. The extracting strip 32 has an angled foot section 41 which is disposed to reach behind the loosened feet 39, as is shown by FIG. 5. The angled foot section is continuous in longitudinal direction, i.e., it is closed, meaning it is without openings or slits. Consequently, an extracting strip 32 can be used for different needle reaches, in which case the distances between the holes 3 are different. The extracting strip 32 is associated with a drive device 42 (FIG. 2), said drive device imparting the extracting strip 32 with an extracting movement symbolized by the arrows. Within this, the extracting strip 32 is initially moved toward the needle board 2. This is essentially a vertical movement, for example. Then, during a second phase of movement, the extracting strip 32 is moved transversely to the felting needle 17, so that the foot section 41 moves between the foot 39 and the needle board 2. During a return stroke, which is essentially directed in axial direction relative to the felting needle 17, said felting needle's holding part 36 is pulled out of the opening 3.

In order to improve said extracting strip's reach behind the feet 3 of the felting needles 17 the extracting strip 32 may be provided with openings that correspond to the distance of the holes 3. Then, the foot section 41 of the extracting strip 32 may partially extend between the felting needles 17, thus improving the extracting operation. This permits the extraction of the felting needles 17 from the needle board 2 when they—rotated by 90 degrees—are arranged in the direction indicated in FIG. 5.

All potential extracting strips 32 can be actuated by only one common drive device 42 and are correspondingly rigidly connected with such a drive device.

In order to catch the pulled-out needles, a needle-collecting pan 43 is provided as indicated in dashed lines in FIG. 2 and better visible in FIG. 1. The needle-collecting pan 43 is arranged diagonally inclined so that needles removed from the needle board 2 by the extracting device 30 are collected by the needle-collecting pan and may slide in said pan to a lower pan section. Intermediate walls provided in the needle-collecting pan 43 ensure that the felting needles 17 slide essentially parallel to each other to the lower pan section and essentially align themselves parallel to each other there. The machine operator in charge of operating the work station may remove the needles there in an ordered manner and move the needles on for recycling or for disposal. Referring to the described procedure, the needles are recovered in a non-destructive manner and, optionally, in a reusable manner.

In order to position in particular the push-out strip(s) 31 in X-direction, preferably at least one sensor device, for example, configured as an image-recording device (camera) 44 is provided in longitudinal direction of the needle board 2 (FIG. 2). This image-recording device is preferably located at a location through which passes a length-side end of the needle board 2 during the transfer from the planting position into the extracting position or needle-removing position or the depressing position 24. The image-recording device 44 "sees" at least one end of each row of holes and can thus detect the position of the end of the row of holes, as well as the existing hole ratio, i.e., the needle or hole distances. In addition, the image-recording device 44 can detect the distance between two rows of holes. In this manner, the machine control unit 26 can initially activate the push-out strip 31 that has the corresponding slit ratio for removing the needles. In addition, the machine control device can affect the transport device 21 in such a manner that the row of needles that is to be pushed out is positioned exactly under the selected push-out strip 31. Preferably, four such push-out strips 31 are provided, however, their number may vary from case to case.

Figure 7:
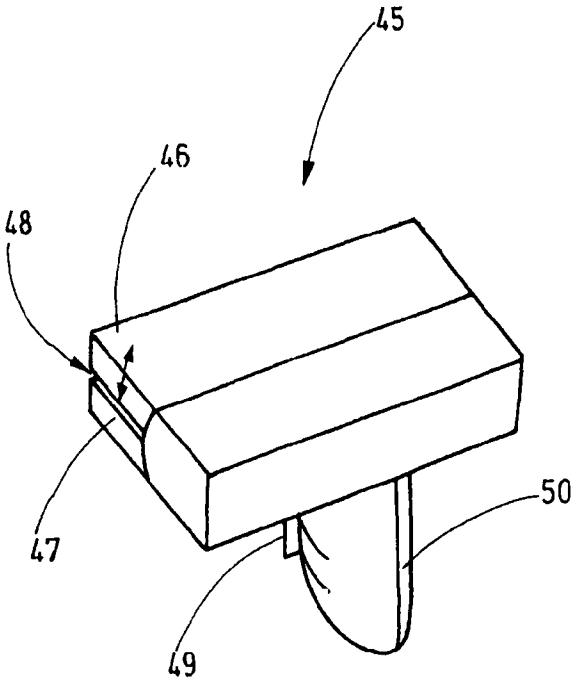
FIG. 7 shows a multiple collet chuck for transferring into a needle board the group of needles presented by the filling device in accordance with FIG. 6 into a needle board.

As is obvious from FIGS. 1 and 7, a multiple collet chuck 45 is used for setting the needles in the needle board 2. Said collet chuck is used to receive felting needles 17 that are to be set in the needle board in the desired ratio (distance from each other). Said collet chuck has at least two chuck jaws 46, 47, at least one of them being supported in a movable manner. The chuck jaws 46, 47 define between them a chuck gap 48, which can be narrowed by suitably actuating a release lever 49, in order to clamp the felting needles in place between the chuck jaws 46, 47. The release lever 49 is preferably located next to a handle 50 that extends from the multiple collet chuck 45.

Figure 6:
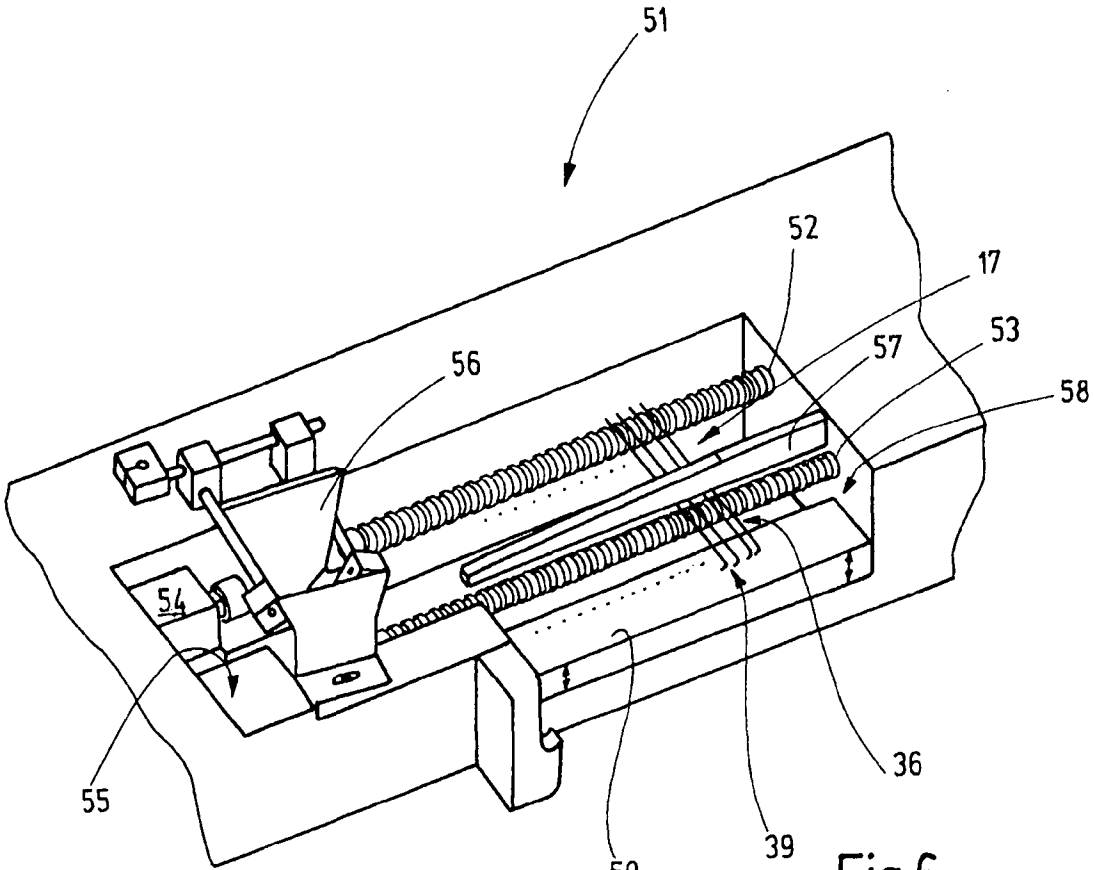
FIG. 6 is a perspective view of a filling device to make available a group of felting needles to a multiple collet chuck.

As shown by FIG. 6, the collet chuck 45 is associated with a filling device 51 that is provided on the device 1 preferably above the holding device 4 so that the handle is within the reach of the machine operator. The filling device 51 is disposed to present, individually or in groups, the felting needles 17 at the desired distance from each other, so that they can be grasped or removed by the collet chuck 45. The filling device 51 represents a worm-type conveyor device and comprises separating means, for example, configured as two parallel threaded spindles 52, 53 having a pitch that corresponds to the hole ratio of the needle board 2. In the case of variable hole distances, the thread pitch may be variably adapted. Both the threaded spindles 52, 53 have corresponding threads (both have right-hand threads or left-hand threads) and are co-rotational. The positioning motors such as, for example, stepper motors 54, 55, are used for rotation. A filling funnel 56 holding the needle supply is arranged above the ends of the threaded spindles 52, 53. Preferably, the filling funnel 56 is equipped with a vibrating device that lightly vibrates said filling funnel in a specific manner.

Preferably, a downholder 57 is arranged between the threaded spindles 52, 53, said downholder being designed in the form of a strip extending parallel to the threaded spindles 52, 53. In addition, said downholder comprises a depressing means that may consist of synthetic material or of a metal.

A cutout 58 is provided next to the threaded spindle 53 in the frame supporting the threaded spindles 52, 53, said cutout allowing the multiple collet chuck 45 access to the holding parts 36 and the feet 39 of the felting needles 17. A vertically movable strip 59 is arranged in the cutout 58. Said strip has on its upper side an essentially flat sliding surface that is located slightly below the lower edge of the downholder 57. The feet 39 slide on the strip 59 and are thus aligned in a uniform manner.

A not specifically illustrated sensor system detects when both threaded spindles 52, 53 are fully filled with felting needles 17, i.e., when each thread contains a felting needle 17. The sensor device then stops the stepper motors 54, 55 and activates the downholder 57 in order to maintain the orientation of the needle feet 39 of the felting needles 17. Subsequently, the strip 59 is lowered. Now the cutout 58 is clear and the felting needles 17 can be grasped by the multiple collet chuck 45 and clamped in place at the pre-specified ratio.

Hereinafter follows a description of the operation of the device 1:

A needle board 2 which is to be planted with at least one row of new needles is first moved toward the device 1. This may be done by means of a suitable carriage or another frame. For example, the needle board 2 is held therein in vertical orientation, whereby the long edge of said needle board is positioned horizontally and its short edge is positioned vertically. Now the needle board 2 can be moved (by hand) onto the holding device 4. In so doing, said needle board is guided by a linear guide device configured as guide rails 8, 9. The rollers 10 through 13 contained therein facilitate this operation. In so doing, the needle board 2 is manually moved (from left to right in FIG. 1) until the outermost needles abut against the abutment 19. By actuating an appropriate switch, now all the rollers 10 through 13 are lowered and the clamping claws 14, 15 are actuated. It is assumed that the needle board 2 is fully loaded with needles and that at least one row of needles is to be removed. An appropriate switch on the device 1 is actuated. Now, the transport device 21 transfers the needle board 2, together with the board frame 4, into the extracting position 24. In so doing, the needle board 2 is rotated in such a manner that the working parts 35 of the felting needles 17 point upward in approximately vertical direction, as shown by FIG. 4.

During the transfer of the needle board 2 out of the right position in FIG. 2 into the extracting position, the needle board 2 must pass through the viewing section of the image-recording device 44. In so doing, said image-recording device has detected the hole ratio of the needle board 2. Now the appropriate push-out strip 31 is selected and the needle board 2 with the line of felting needles that is to be pushed out is exactly positioned under this push-out strip 31. The transverse positioning of the needle board 2 is achieved by abutment of the felting needles against the abutment 19. Generally, sufficient accuracy is achieved by the relative positioning of the push-out strip 31. Considering fine felting needles, in particular, it may further be effective if the accurate dimensional reference is established by the image-recording device 44 and the push-out strip 31 and/or the needle board 2 is readjusted by a transverse movement (perpendicular to the plane of projection in FIG. 2).

Preferably, the coordinates of the openings 3 of a needle board 2 are detected prior to the planting operation. To achieve this, it is necessary that the openings 3 be free of felting needles 17. As a rule, the detection of the coordinates is a one-time operation.

This is followed by the loosening of the felting needle 17 in that the push-out strip 31 is lowered to such an extent that the feet 39 of the felting needles 17 are slightly pushed away from the needle board 2. In so doing, the felting needles 17 move out of the position shown in FIG. 4 into the position shown in FIG. 5. Once this has been done, the push-out strip 31 may move back into its home position. The extracting strip 32 now pulls out the previously loosened felting needles 37, said strip reaching behind the feet 39 and pulling them away from the needle board 2. The loosened felting needles 17 drop out of the needle board 2 into the needle-collecting pan 43, in which they slide downward—ordered parallel with respect to each other—into a front position of the machine, where they can be effortlessly removed by a machine operator.

Once the row of needles has been removed, the needle board 2 can be returned into its planting position. If several new rows of needles are to be planted, it is also possible to first remove the needles from the rows that are to be newly planted. To do so, the needles of the rows of needles are removed following appropriate positioning of the needle board 2 as described above.

In order to replant needles on the needle board 2 or in the openings 3, from which needles have been removed, the transport device 21 is controlled in such a manner that said needle board is again moved into the position on the right in FIG. 2. The machine operator standing in front of the machine can now use the multiple collet chuck 45 to set needles into the needle board 2 that is held like a desk (see FIG. 1). To do so, the machine operator uses the multiple collet chuck 45 to grasp the needles on their holding parts 36, said needles being carried by the threaded spindles 52, 53 (FIG. 6). The orientation of the feet 39 is maintained in the multiple collet chuck 45. While the machine operator plants a set of needles or a group of felting needles 17 by means of the multiple collet chuck 45 in the appropriate openings 3 of the needle board 2, a corresponding sensor system of the filling device 51 detects that the threaded spindles 52, 53 are empty and starts up the stepper motors 54, 55, as well as, optionally, the vibrating device, in order to allow the needles to drop from the supply container or from the filling funnel 36 onto the separating device configured as the threaded spindles 52, 53 and in order to allow said needles to be separated consistent with the thread pitch. The strip 59 is again in its upper position and aligns the feet of the felting needles 17. As soon as both threaded spindles 52, 53 are full, the filling device 1 stops again. The machine operator may now use the multiple collet chuck 45 to pick up the next group of needles and set them in the needle board 2. In so doing, the machine operator must only be ensure that the working parts 35 of the felting needles 17 find their corresponding openings 3. Once the machine operator has planted the pre-specified needles 17 on the needle board 2, he/she actuates the function of pushing-in the felting needles 17 of the device 1. To do so, the machine control actuates the transport device 21 and now transfers the needle board, with the downward-facing working parts, into the depressing position 24 under the push-in strip 27. The hydraulic cylinders 28 are actuated. During its downward motion, the push-in strip 27 now pushes all the holding parts 36 into the needle board 2 until the feet 39 are in contact with the needle board 2.

If several rows of needles are to be planted at the same time, the push-in strip 27 is again briefly moved away from the needle board 2, and the needle board 2 is advanced by the distance of one row, said distance having been determined beforehand by the image-recording device 44, so that the next row of needles is positioned below the pressure surface 29 of the push-in strip 27.

Once all the needles 17 have been pushed in, the needle board 2 is again moved into its planting position (on the right in FIG. 2), and the clamping claws 14, 15 are released. Now, it is possible to again move—with minimal force due to the existing rollers 10 through 13—the fully or partially loaded needle board 2 laterally away from the board frame 5.

The filling device 51 absolutely pre-specifies a foot orientation of the feet 39. If, alternatively, an opposing foot orientation is to be achieved, a second mirror-image-like filling device 51*a* may be provided (FIG. 1). While the filling device 51 moves the felting needles 17 from left to right, the filling device 51*a* moves the felting needles 17 from right to left. This results in an opposing foot orientation. The machine operator may alternatively use the filling device 51 or the filling device 51*a*.

If the machine operator wishes to change the pre-specified ratio, he/she may exchange the threaded spindles 52, 53. A corresponding supply of spindles is held ready at the semi-automatic loader. By means of appropriate positive clutches, the machine operator sets the threaded spindles 52, 53 in the appropriate desired rotary position in the filling device 51. The threaded spindles may be exchanged in accordance with a prompt on a display screen, said prompt being given by the machine control consistent with the ratio detected by the image-recording device 44.

A semi-automatic loader for needle boards 2 comprises a filling device 51 that presents felting needles 17 arranged at a ratio that is consistent with the ratio of holes of a needle board. A machine operator can then grasp the felting needles 17 by means of a multiple collet chuck 45 and set them in groups in the rows of holes of the needle board 2. This provides a loading method featuring extremely high productivity.

It will be appreciated that the above description of the present invention is susceptible to various modifications, changes and modifications, and the same are intended to be comprehended within the meaning and range of equivalents of the appended claims.

LIST OF REFERENCE NUMBERS

1 Device
2 Needle board
3 Openings
4 Holding device
5 Board frame
6 Axis of rotation
7 Board guide
8 Guide rail
9 Guide rail
10 Roller
11 Roller
12 Roller
13 Roller
14 Clamping claw
15 Clamping claw
16 Opening
17 Felting needles
18 Abutment
19 Abutment
20 Positioning device
21 Transport device
22 Rails
23 Carriage
24 Depressing and needle-removing position
25 Hood
26 Machine control device
27 Push-in strip
28 Hydraulic cylinder
29 Pressure surface
30 Extracting device
31 Push-out strip
32 Extracting strip
33 Foot section
34 Section
35 Working part
36 Holding part
37 Slit
38 Conical section
39 Foot
40 Drive device
41 Foot section
42 Drive device
43 Needle-collecting pan
44 Image-recording device
45 Multiple collet chuck
46 Chuck jaws
47 Chuck jaws
48 Chuck gap
49 Release lever
50 Handle
51, 51*a* Filling device
51 Threaded spindle
52 Threaded spindle
53 Stepper motor
54 Stepper motor
55 Filling funnel
56 Downholder
57 Section
58 Strip

What is claimed is:

1. Method for setting felting needles (17) in the needle boards (2) of a felting machine, said needles having a working part (35) and a holding part (36), whereby said method comprises the following steps:

providing a needle board (2) having a number of openings (3) that are designed to accommodate felting needles (17) and that are arranged at pre-specified distances;

providing a multiple collet chuck (45) that is designed for picking up several felting needles (17) in that said collet chuck grasps the holding part (36) of said needles;

inserting a group of felting needles (17) in the multiple collet chuck (45), said needles being aligned parallel in longitudinal direction;

inserting at least one of the working parts (35) of the felting needles (17) held by the multiple collet chuck (45) in the openings (3) of the needle board (2); and pushing of the holding parts (36) of the felting needles (17) into the openings (3) of the needle board (2).

2. Method in accordance with claim 1, characterized in that the felting needles (17) are supplied in groups to the multiple collet chuck (45).

3. Method in accordance with claim 1, characterized in that the felting needles (17) are held at distances from each other in the multiple collet chuck (45), said distances corresponding to the distances between the holes.

4. Method in accordance with claim 1, characterized in that the holding parts (36) are pushed in only after all the felting needles (17) intended to be set in the needle board (2) have been planted in their openings (3).

5. Method in accordance with claim 1, characterized in that the needle board (2) is loaded in a planting position that is different from the position in which the holding parts (36) of the felting needles (17) are pushed into the openings (3) of the needle board (2).

6. Method in accordance with claim 1, characterized in that the existing felting needles are removed from the openings (3) before the felting needles (17) are planted.

7. Method in accordance with claim 6, characterized in that, in a two-step process, the felting needles that are to be removed are first loosened by means of a push-out strip (31) and then extracted, from another side of the needle board, by means of an extracting device (3).

* * * * *